US008294072B2

(12) United States Patent
Geswender et al.

(10) Patent No.: US 8,294,072 B2
(45) Date of Patent: Oct. 23, 2012

(54) PROJECTILE THAT INCLUDES AS NEEDED PRESSURE-RELIEVING WRAP-AROUND TAIL FINS

(75) Inventors: Chris E. Geswender, Green Valley, AZ (US); Mark E. Elkanick, Tucson, AZ (US); Craig O. Shott, Benson, AZ (US)

(73) Assignee: Raytheon Company, Waltham, MA (US)

( * ) Notice: Subject to any disclaimer, the term of this patent is extended or adjusted under 35 U.S.C. 154(b) by 513 days.

(21) Appl. No.: 12/789,068

(22) Filed: May 27, 2010

(65) Prior Publication Data

US 2012/0199691 A1 Aug. 9, 2012

(51) Int. Cl.
*F42B 15/00* (2006.01)

(52) U.S. Cl. ..... 244/3.29; 244/3.24; 244/3.27

(58) Field of Classification Search ..... 244/3.23, 244/3.24, 3.27, 3.28, 3.29, 3.3
See application file for complete search history.

(56) References Cited

U.S. PATENT DOCUMENTS

| | | | | |
|---|---|---|---|---|
| 4,796,835 | A * | 1/1989 | Galvin | 244/3.29 |
| 6,325,325 | B1 * | 12/2001 | Bonnet et al. | 244/3.24 |
| 6,682,014 | B1 * | 1/2004 | Hickey | 244/3.27 |
| 7,800,032 | B1 * | 9/2010 | Facciano et al. | 244/3.24 |
| 2010/0102161 | A1 * | 4/2010 | Geswender et al. | 244/3.27 |

* cited by examiner

*Primary Examiner* — Timothy D Collins
*Assistant Examiner* — Jamie S Stehle
(74) *Attorney, Agent, or Firm* — Schwegman Lundberg & Woessner, P.A.

(57) ABSTRACT

Some embodiments pertain to a projectile that includes a casing and a plurality of fins which are secured to the casing. Each of the fins is movable between a stowed position and a deployed position. The fins are typically in the stowed position during storage and launch, and move to the deployed position as soon as possible after launch. Each fin includes a first foil that has a first set of openings and a second foil that includes a second set of openings. The first sets of openings in the first foils are aligned with the second sets of openings in the second foils when each of the fins is in the stowed position. The first sets of openings in the first foils are not aligned with the second sets of openings in the second foils when each of the fins is in the deployed position.

17 Claims, 8 Drawing Sheets

PROJECTILE THAT INCLUDES AS NEEDED PRESSURE-RELIEVING WRAP-AROUND TAIL FINS

TECHNICAL FIELD

Embodiments pertain to a projectile that includes wrap-around tail fins, and more particularly to a projectile that includes as needed pressure-relieving wrap-around tail fins.

BACKGROUND

The tail fin configuration in projectiles is an important aspect in determining projectile performance. One known tail fin configuration includes fins that cause the projectile to spin during flight. One of the drawbacks with projectiles that include this type of fin configuration is that the projectiles have limited maneuverability rendering them inadequate from many applications.

Another known tail fin configuration for projectiles is a scissors-type tail fin that allows the projectile to perform well but can be quite costly. The cost associated with scissors-type tail fins has lead to the development of projectiles that include wrap-around tail fins.

There are some inherent design constraints that are associated with configuring projectiles to include wrap-around tail fins. These design constraints are even more problematic than the usual design constraints because projectiles with wrap-around tail fins have not previously been used in conjunction with muzzle brakes, and many of the cannons that are used to launch projectiles are now using some form of muzzle brake.

Muzzle brakes are now typically included in cannons that are used to launch projectiles because muzzle brakes reduce recoil within a cannon by capturing and deflecting gas which is generated during projectile launch from the cannon. When a cannon with a muzzle brake is used to launch a projectile that includes wrap-around tail fins, the wrap-around tail fins must delay opening until the tail fins have exited the cannon. The wrap-around tail fins are usually configured to open as soon as possible after exiting the cannon.

One of the drawbacks that is associated with using a wrap-around tail fin configuration on projectiles that are launched from cannons which include muzzle brakes is that the wrap-around tail fins undesirably trap gas as the projectile is launched from the cannon. This gas trapping within the wrap-around tail fins can cause unwanted damage to the projectile and/or the cannon that launches the projectile. In addition, the unwanted trapping of gases by the wrap-around tail fins during launch of the projectile may adversely affect the initial operation of the projectile.

The drawbacks that are associated with gas trapping can be overcome by including openings in the wrap-around tails fins. The openings allow gas that is expelled by the projectile during launch to pass through the openings in order to relieve pressure. However, the addition of such openings in the fins causes unwanted drag on the fins once the fins are deployed during flight.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, fins are meant to include any surface that generates aerodynamic forces and/or moments. Some example terms for such surfaces include tail, fin, wing, strake or canard (among others).

As used herein, projectile refers to missiles, guided projectiles, unguided projectiles and sub-munitions.

Figure 1:
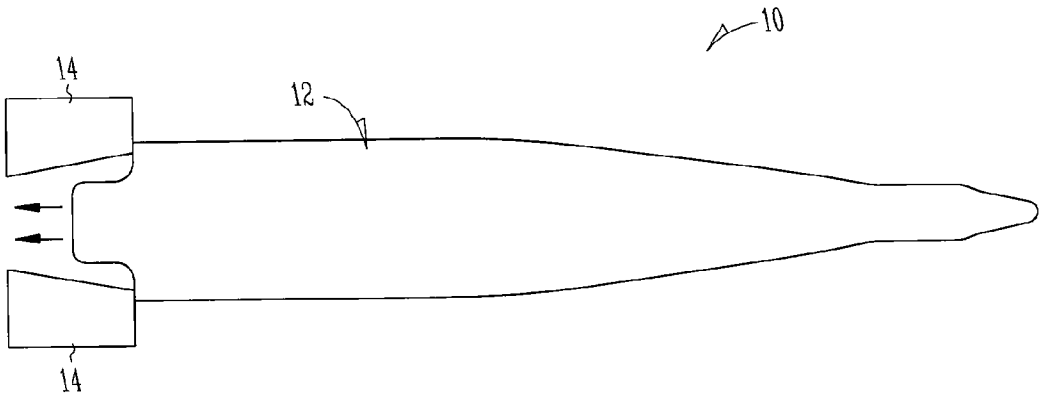
FIG. 1 is a side view of an example projectile.
Figure 2:
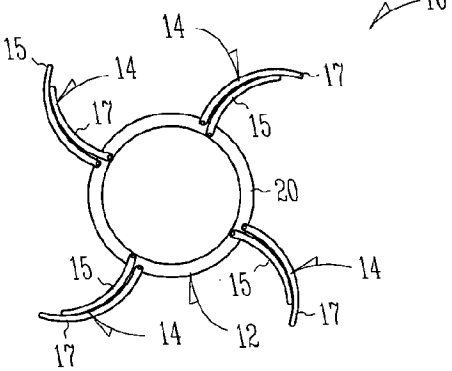
FIG. 2 is rear view of the projectile shown in FIG. 1 with the tail fins deployed.
Figure 3:
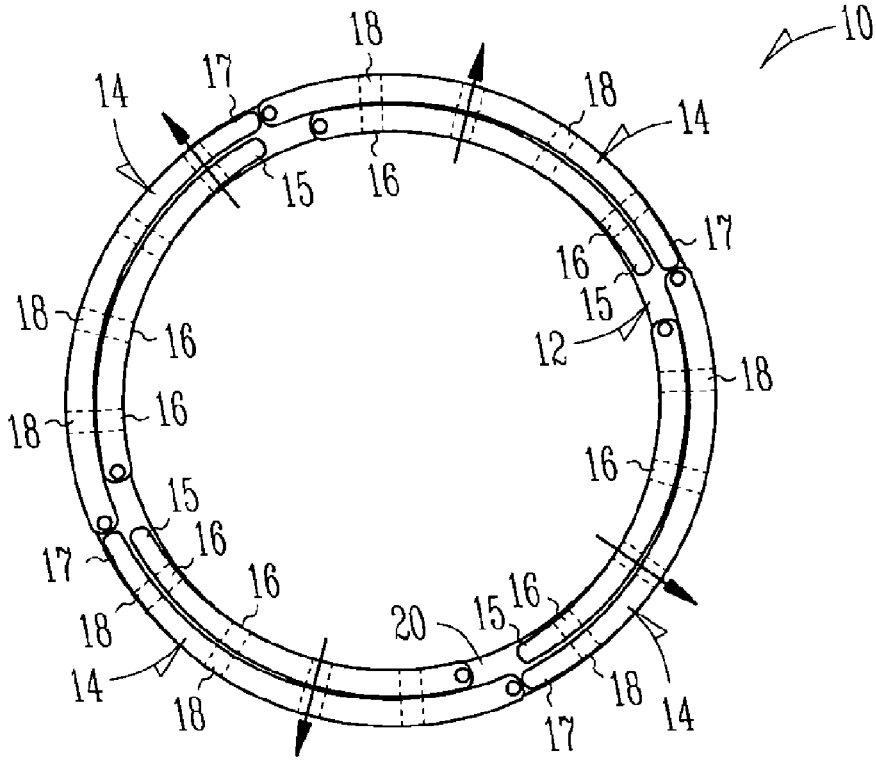
FIG. 3 is an enlarged rear view rear view of the projectile shown in FIG. 1 with the tail fins stowed.
Figure 4:
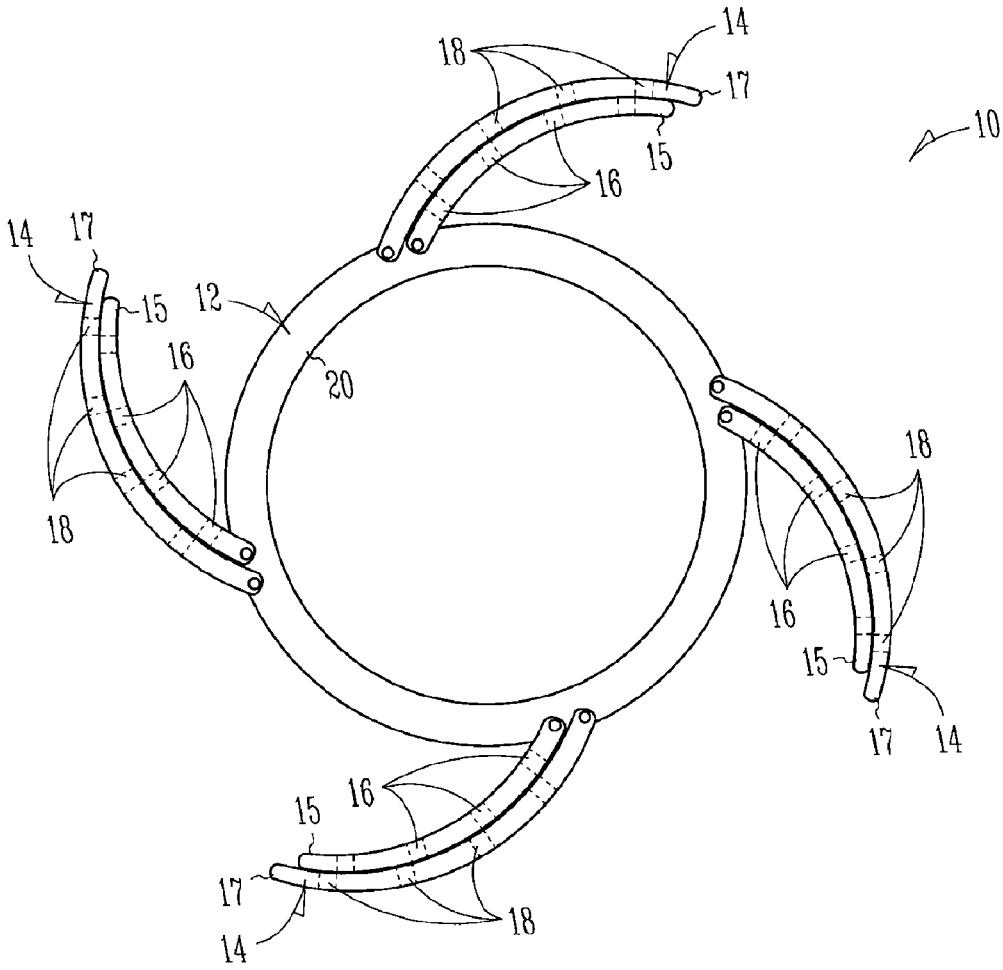
FIG. 4 is an enlarged rear view rear view of the projectile shown in FIG. 1 with the tail fins partially deployed.
Figure 5:
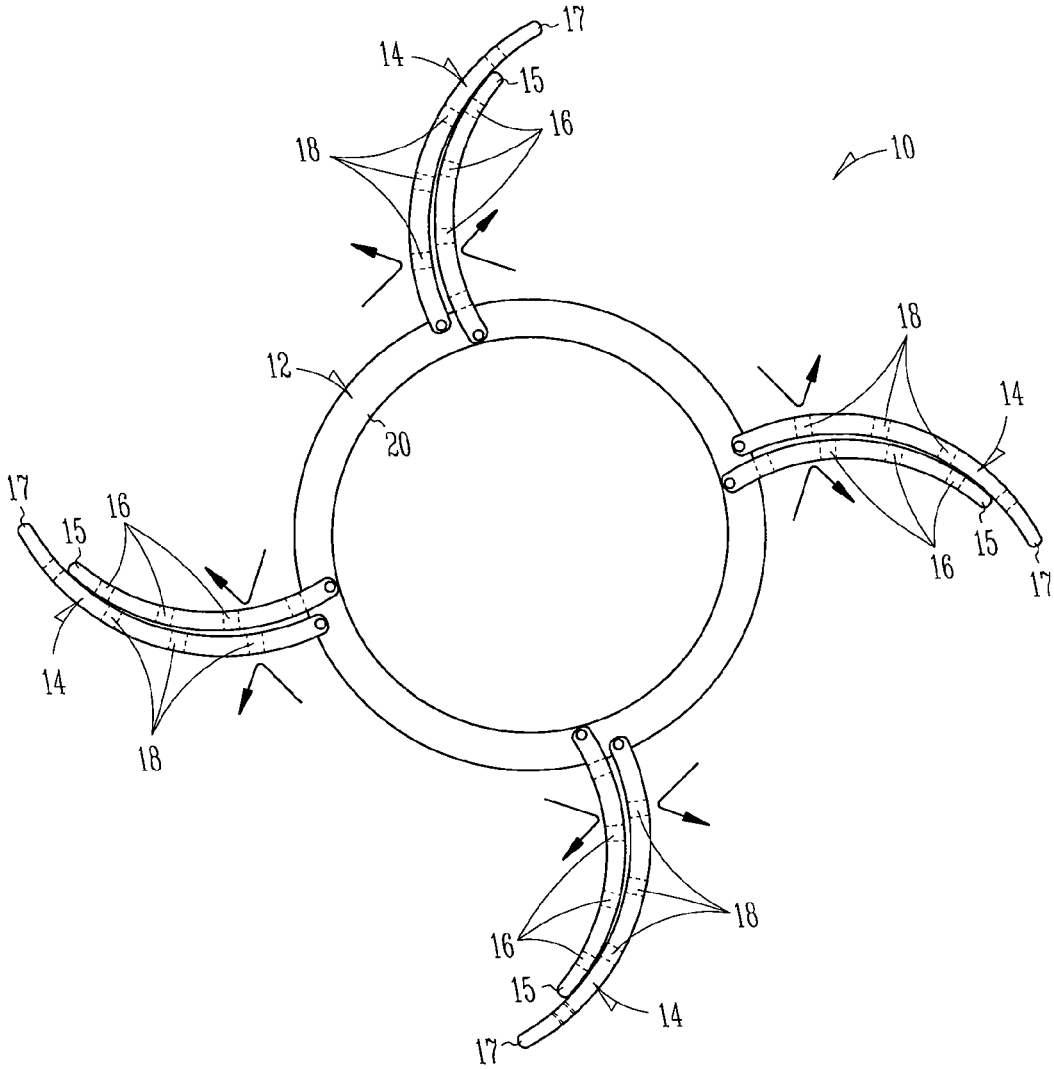
FIG. 5 is an enlarged rear view rear view of the projectile shown in FIG. 1 with the tail fins fully deployed.

FIGS. 1-5 illustrate an example projectile 10. The projectile 10 includes a casing 12 and a plurality of fins 14 that are secured to the casing 12. Each of the fins 14 is movable between a stowed position (FIG. 3) and a deployed position (FIGS. 1, 2 and 5). FIG. 4 shows the fins 14 as the fins 14 move between the stowed position and the deployed position. The fins 14 are typically in the stowed position while the projectile 10 is positioned with a cannon (not shown) that launches the projectile 10 and moves to the deployed position as soon as possible after the projectile 10 exits the cannon.

Each of fins 14 includes a first foil 15 that has a first set of openings 16 and a second foil 17 that includes a second set of openings 18. The first sets of openings 16 in the first foils 15 are aligned with the second sets of openings 18 in the second foils 17 when each of the fins 14 is in the stowed position. The first sets of openings 16 in the first foils 15 are not aligned with the second sets of openings 18 in the second foils 17 when each of the fins 14 is in the deployed position.

Since the first sets of openings 16 in the first foils 15 are aligned with the second sets of openings 18 in the second foils 17 when each of the fins 14 is in the stowed position, the fins 14 allow gas that is expelled from the projectile 10 during launch to flow through the first sets of openings 16 and the second sets of openings 18. As the gas flows through the first sets of openings 16 and the second sets of openings 18 pressure is relieved within a muzzle brake of a cannon that launches the projectile 10. In addition, since the first sets of openings 16 in the first foils 15 are not aligned with the second sets of openings 18 in the second foils 17 when each of the fins 14 is in the deployed position, the air resistance that is typically generated on the fins 14 during flight of the projectile 10 is significantly reduced.

As shown in FIGS. 4-7, the casing 12 may include a baffle 20 such that gases expelled during launch of the projectile 10 travel through the baffle 20. During launch of the projectile 10, each of fins 14 may be oriented in the stowed position such that gases are expelled through the baffle 20 and then through the first set of openings 16 in the first foil 15 and the second set of openings 18 in the second foil 17.

In the illustrated example embodiments, the first foil 15 in each fin 14 is rotatably connected to the baffle 20 and the second foil 17 in each fin 14 is rotatably connected to the baffle 20. However, it should be noted that the fins 14, including the first and second foils 15, 17, may be connected to the baffle 20 (or casing 12) in any manner that allows the first and second foils 15, 17 to move relative to one another.

Embodiments are also contemplated where the first and second foils 15, 17 are movably attached to one another. In addition, the projectile 10 may include any type of mechanism (not shown) that locks the first and second foils 15, 17 into place once the fins 14 move into the deployed position.

Figure 6:
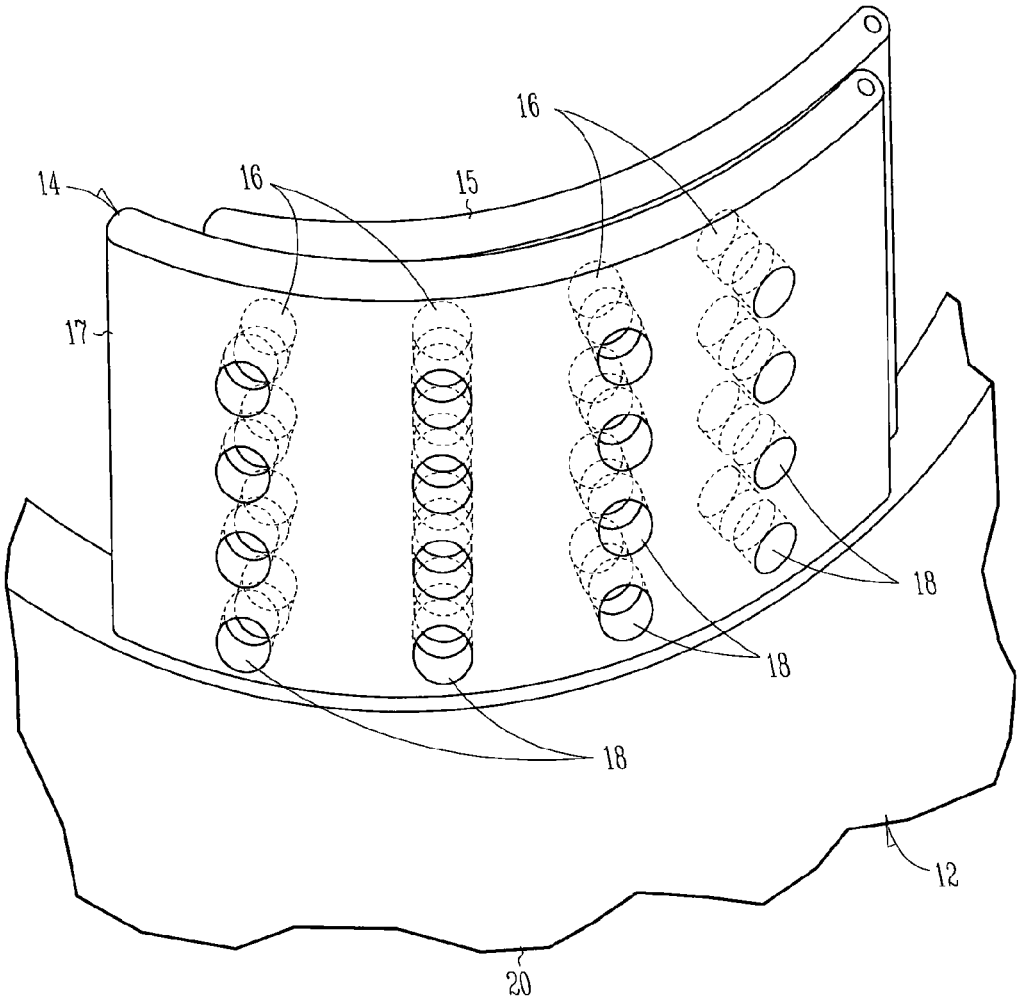
FIG. 6 is an enlarged perspective view of one of the tail fins attached to a baffle where the tail fin is stowed.

As shown most clearly in FIGS. 3 and 6, the first foil 15 in each fin 14 may be aligned with the baffle 20 when each fin 14 is in the stowed position and the second foil 17 in each fin 14 may be aligned with the baffle 20 when each fin 14 is in the stowed position. It should be noted that embodiments are contemplated where the first and/or second foils 15, 17 are not necessarily aligned with the baffle 20 (or any other part of the casing 12).

In the illustrated example embodiments, the first foil 15 in each fin 14 is arcuate-shaped and the second foil 17 in each fin 14 is arcuate-shaped. However, it should be noted that the first and second foils 15, 17 may be any shape as long as (i) the first sets of openings 16 in the first foils 15 are aligned with the second sets of openings 18 in the second foils 17 when each of the fins 14 is in the stowed position; and (ii) the first sets of openings 16 in the first foils 15 are not aligned with the second sets of openings 18 in the second foils 17 when each of the fins 14 is in the deployed position.

In addition, the first foil 15 in each fin 14 may be the same size and shape as the second foil 17 in each fin 14. Although embodiments are contemplated where the first and second foils 15, 17 are different sizes and/or shapes.

Figure 9:
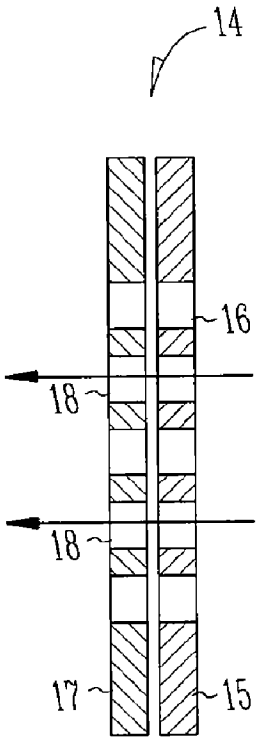
FIG. 9 is a section view taken along line 9-9 in FIG. 8.
Figure 8:
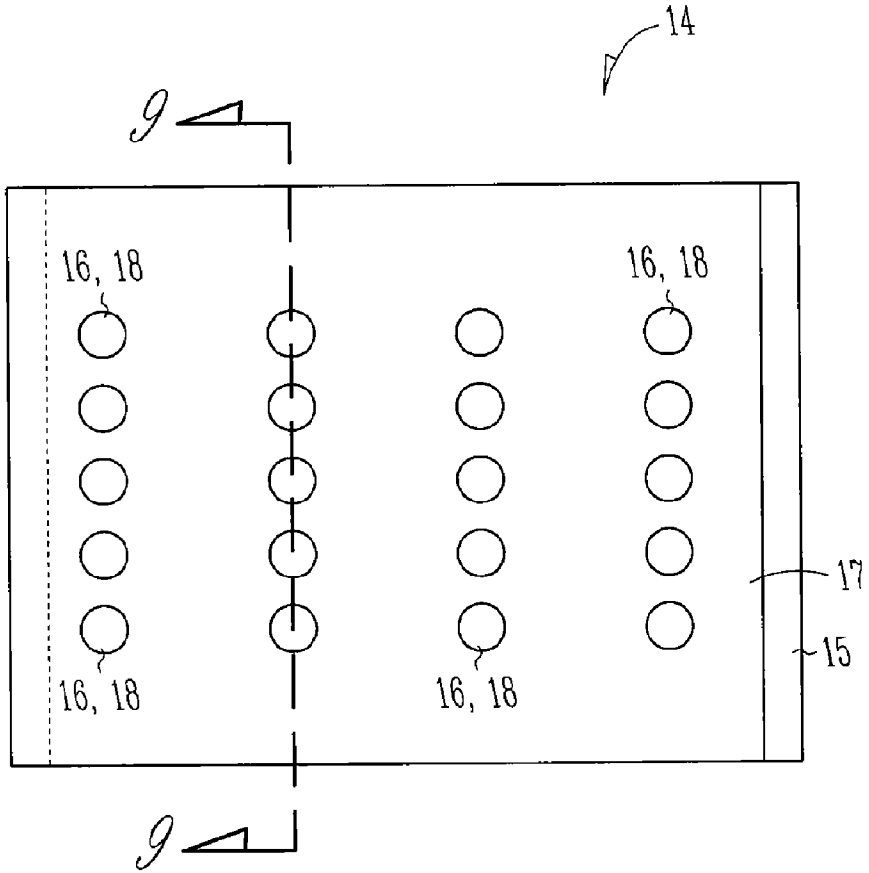
FIG. 8 is an enlarged plan view of one tail fin where the tail fin is stowed.
Figure 11:
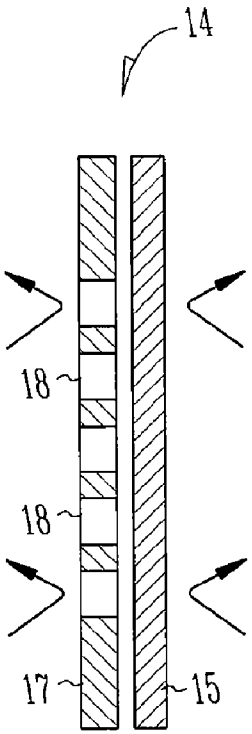
FIG. 11 is a section view taken along line 11-11 in FIG. 10.
Figure 10:
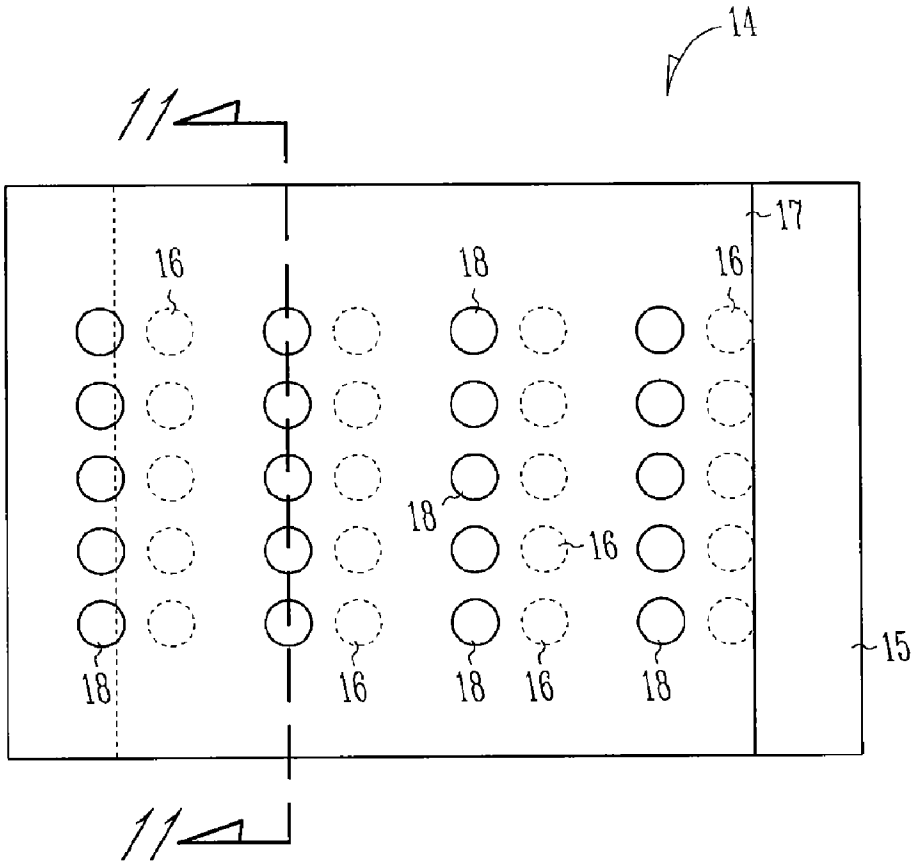
FIG. 10 is an enlarged plan view of one tail fin where the tail fin is deployed.

As shown most clearly in FIGS. 8-11, each opening 16 in the first sets of openings 16 is the same size and shape as each opening 18 in the second sets of openings 18. However, it should be noted that the first and second sets of openings 16, 18 may be different sizes and/or shapes as long as at least a portion of each opening 16 in the first set of openings 16 is aligned with each opening 18 in the second sets of openings 18 when each of the fins 14 is in the stowed position. FIGS. 8-9 show a fin 14 in the stowed position where the first and second sets of openings 16, 18 are fully aligned while FIGS. 10-11 show a fin 14 in the deployed position where no portion of the first and second sets of openings 16, 18 are aligned.

In addition, although the FIGS. only illustrate each opening 16 in the first sets of openings 16 as being a circular opening and each opening 18 in the second sets of openings 18 as being a circular opening, other embodiments are contemplated where the openings 16, 18 in the first and second sets of openings 16, 18 have different shapes. The size, shape and alignment of the first and second sets of openings 16, 18 will depend in part on the type of fin 14 that is utilized on the projectile 10 as well as the application where the projectile 10 is to be used.

Figure 7:
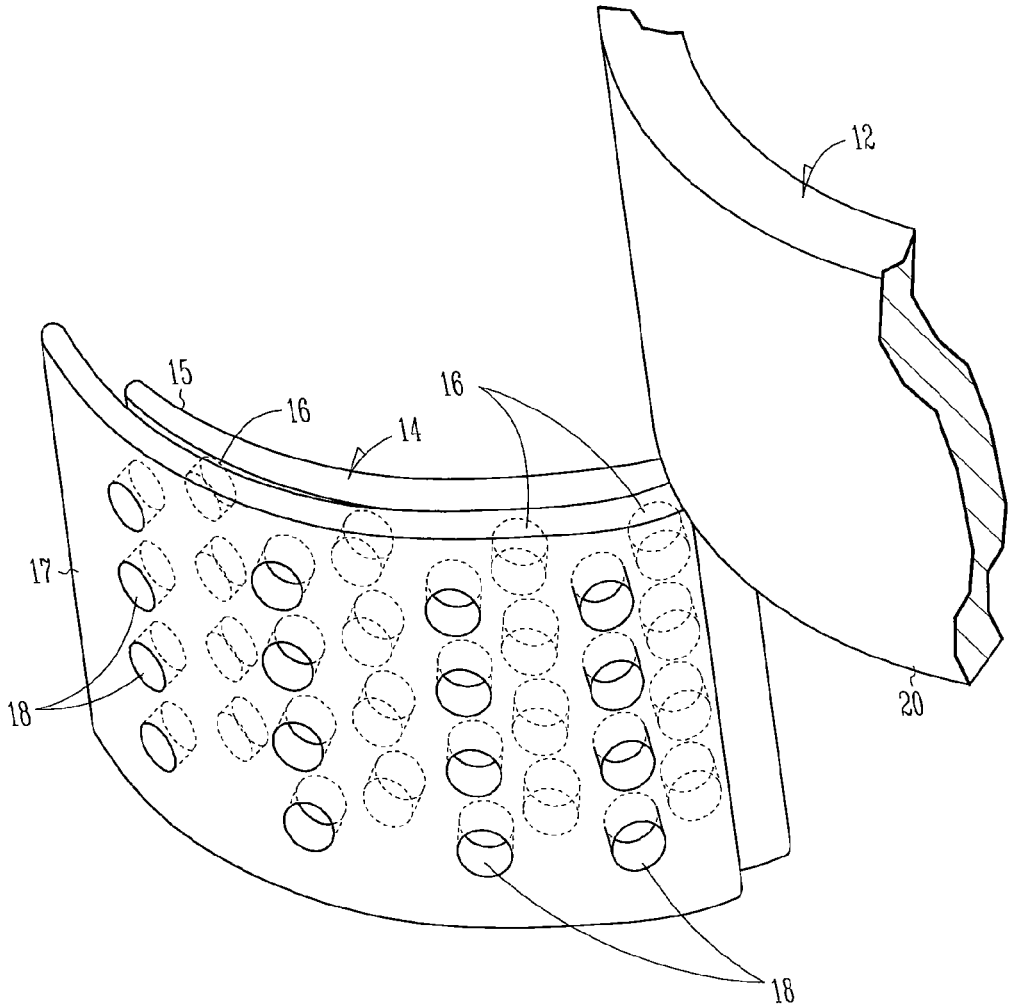
FIG. 7 is an enlarged perspective view similar to FIG. 6 where the tail fin is deployed.

In some embodiments, the first and second foils 15, 17 in each fin 14 rotate 90 degrees as each fin 14 moves from the stowed position (see FIGS. 3 and 6) to the deployed position (see FIGS. 5 and 7). It should be noted that in other embodiments the first and second foils 15, 17 in each fin 14 may rotate more or less than 90 degrees as each fin 14 moves from the stowed position to the deployed position.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A projectile comprising:

a casing;

a plurality of fins secured to the casing, each of the fins being movable between a stowed position and a deployed position, wherein each of fins includes a first foil that includes a first set of openings and a second foil that includes a second set of openings, wherein the first sets of openings in the first foils are aligned with the second sets of openings in the second foils when each of the fins is in the stowed position, and wherein the first sets of openings in the first foils are not aligned with the second sets of openings in the second foils when each of the fins is in the deployed position.

2. The projectile of claim 1 wherein the casing includes a baffle such that gases which are expelled during launch of the projectile travel through the baffle.

3. The projectile of claim 2 wherein each of fins is in the stowed position during launch of the projectile such that the gases that are expelled through the baffle during launch of the projectile are able to pass through the first set of openings in the first foil and the second set of openings in the second foil.

4. The projectile of claim 2 wherein the first foil in each fin is rotatably connected to the baffle and the second foil in each fin is rotatably connected to the baffle.

5. The projectile of claim 2 wherein the first foil in each fin is aligned with the baffle when each fin is in the stowed position and the second foil in each fin is aligned with the baffle when each fin is in the stowed position.

6. The projectile of claim 1 wherein the first foil in each fin is arcuate-shaped and the second foil in each fin is arcuate-shaped.

7. The projectile of claim 1 wherein the first foil in each fin is the same size and shape as the second foil in each fin.

8. The projectile of claim 1 wherein each opening in the first sets of openings is the same size and shape as each opening in the second sets of openings.

9. The projectile of claim 1 wherein each opening in the first sets of openings is a circular opening and each opening in the second sets of openings is a circular opening.

10. The projectile of claim 1 wherein the first and second foils in each fin move relative to one another as each fin moves from the stowed position to the deployed position.

11. The projectile of claim 1 wherein the first and second foils in each fin rotate 90 degrees as each fin moves from the stowed position to the deployed position.

12. A projectile comprising:

a casing that includes a baffle such that gases which are expelled during launch of the projectile travel through the baffle;

a plurality of fins rotatably secured to the baffle, each of the fins being movable between a stowed position and a deployed position, wherein each of fins includes a first arcuate-shaped foil that includes a first set of circular openings and a second arcuate-shaped foil that is the same size and shape as the first arcuate-shaped foil and includes a second set of circular openings, wherein the first sets of circular openings in the first arcuate-shaped foils are aligned with the second sets of circular openings in the second arcuate-shaped foils when each of the fins is in the stowed position, and wherein the first sets of circular openings in the first arcuate-shaped foils are not aligned with the second sets of circular openings in the second arcuate-shaped foils when each of the fins is in the deployed position, and wherein the first and second arcuate-shaped foils in each fin rotate 90 degrees as each fin moves from the stowed position to the deployed position.

13. The projectile of claim 12 wherein each of fins is in the stowed position during launch of the projectile such that the gases which are expelled through the baffle during launch of the projectile pass through the first set of circular openings in the first arcuate-shaped foil and the second set of circular openings in the second arcuate-shaped foil, wherein the first arcuate-shaped foil in each fin is aligned with the baffle when each fin is in the stowed position and the second arcuate-shaped foil in each fin is aligned with the baffle when each fin is in the stowed position.

14. A projectile comprising:

a plurality of fins, each of the fins comprising a first and second foil and being movable between a stowed position and a deployed position, wherein in the stowed position, openings in the first foil are aligned with openings in the second foil to allow gases to be expelled during launch, and wherein in the deployed position, the openings in the first foil are not aligned with openings in the second foil to reduce friction during flight.

15. The projectile of claim 14 further comprising a casing including a baffle, the baffle to allow gases expelled during launch of the projectile travel therethrough.

16. The projectile of claim 15 wherein the first and second foils in each fin move relative to one another as each fin moves from the stowed position to the deployed position.

17. The projectile of claim 16 wherein the projectile is a guided projectile.

* * * * *